US005129319A

United States Patent [19]

Umetsu

[11] Patent Number: 5,129,319

[45] Date of Patent: Jul. 14, 1992

[54] SAFETY DEVICE FOR INK FORMING ROLLERS

[75] Inventor: Isao Umetsu, Chiba, Japan

[73] Assignee: Komori Corporation, Tokyo, Japan

[21] Appl. No.: 687,832

[22] Filed: Apr. 19, 1991

[30] Foreign Application Priority Data

May 7, 1990 [JP] Japan ..... 2-46868[U]

[51] Int. Cl.[5] ..... B41F 5/00

[52] U.S. Cl. ..... 101/216; 101/348; 92/19; 92/21 MR

[58] Field of Search ..... 384/906; 160/300, 303; 101/212, 216, 348, 375, 152, 153; 242/68.4; 254/93 L; 269/69, 208; 92/15, 19, 21 MR

[56] References Cited

U.S. PATENT DOCUMENTS 4,372,205 2/1983 Pflaum ..... 101/153
4,535,947 8/1985 Hidle ..... 242/68.4
4,901,641 2/1990 Steiner et al. ..... 101/216

FOREIGN PATENT DOCUMENTS 1205984 12/1965 Fed. Rep. of Germany ..... 101/216

*Primary Examiner*—Edgar S. Burr
*Assistant Examiner*—Stephen R. Funk
*Attorney, Agent, or Firm*—Abelman Frayne and Schwab

[57] ABSTRACT

In a safety device for ink forming rollers, each of the rollers is supported on a frame through a moving shaft movable in an axial direction to remove the ink forming roller, a safety pin is provided which is urged and supported on the frame, the moving shaft is formed with a recess for engagement with the safety pin and guide surface for guiding the safety pin to the recess against the urging force of the safety pin. When the ink forming roller is mounted, the safety pin automatically engages to interrupt movement of the moving shaft, thereby preventing the ink forming roller from falling down due to an external cause such as a power stoppage or a misoperation, and the safety device being prevented from careless locking failure, thereby improving the safety of the printing machine.

5 Claims, 3 Drawing Sheets

SAFETY DEVICE FOR INK FORMING ROLLERS

FIELD OF THE INVENTION

This invention relates to a safety device for ink forming rollers which contact the outer peripheral portion of a plate cylinder to apply ink thereto.

BACKGROUND OF THE INVENTION

A printing machine is equipped with a sheet feeder, a printing unit, a paper discharge device, and an ink unit, and this printing unit is in contact with a blanket cylinder, an impression cylinder, a transfer cylinder, a plate cylinder and the like, and supported on a shaft. The inking unit is provided with a group of rollers including ink forming rollers corresponding to the plate cylinder, and ink fountains.

A plurality of the ink forming rollers contact a single plate cylinder, individually applying ink of different colors to the plate cylinder. The ink forming rollers are provided with patterns according to the printed matter, and, therefore must be replaced when the printed matter is changed or the roller surface is worn out.

Prior art ink forming rollers are rotatably supported on the frames, and one end of each cylinder is supported by a moving shaft which is supported on the frames and movable in the axial direction. The moving shaft is mounted with a hydraulic cylinder to which a hydraulic pump is connected. The ink forming rollers are replaced by operating the hydraulic cylinder to move the moving shaft, allowing removal of the ink forming rollers from the frames.

Such ink forming rollers are removed by moving the moving shaft in the axial direction by means of the hydraulic cylinder. Therefore the positional holding of the ink forming rollers depends on the hydraulic cylinder. If the hydraulic pump stops due to a power failure or the like, the pressure of the hydraulic cylinder decreases. As a result, the retaining force on the moving shaft, and, in turn, on the ink forming rollers is decreased, and the ink forming rollers can fall down from the frames due to their weight.

Furthermore, since the operation of the hydraulic cylinder is controlled by the pressing of a button by an operator, if the operator presses the button by mistake during operation of the printing machine, there may occur defective printing or damage to the ink forming rollers or even damage to the printing machine.

To prevent this, a safety pin has been provided in order to prevent the ink forming rollers from falling down even when the hydraulic pump stops or due to the operator's misoperation. Therefore, when the ink forming rollers are mounted, this safety pin is moved by the operator to lock the ink forming rollers, thereby retaining the ink forming rollers in position. When the safety pin is moved to an unlock position to unlock the ink forming rollers, the rollers can then be replaced.

Such a safety pin is provided to prevent the ink forming rollers from falling down due to a stoppage of the hydraulic pump or the operator's misoperation. However, since the safety pin is operated manually by the operator, the operator may fail to move the pin to the lock position when the ink forming rollers are mounted. In such a case, the ink forming rollers cannot be prevented from falling down due to a stoppage of the hydraulic pump or the operator's misoperation, and the ink forming rollers or even the printing machine may be damaged.

SUMMARY OF THE INVENTION

With a view to eliminate such prior art problems, it is a primary object of the present invention to provide a safety device for ink forming rollers, which positively prevents the ink forming rollers from falling down for improving the safety of the printing machine.

In accordance with the present invention, there is provided a safety device for ink forming rollers which are rotatably disposed in contact with the outer peripheral surface of a plate cylinder, one end being supported on a frame through a moving shaft, and detachable from the frame by moving the moving shaft in an axial direction, comprising a safety pin provided on the frame and urged in a direction to engage into the moving shaft, the moving shaft being formed with a recess for engagement with the safety pin and a guide surface for guiding the safety pin to the recess against the urging force when mounting the ink forming rollers.

When the ink forming rollers are mounted, the guide surface of the moving shaft moves the safety pin against the urging force to automatically guide the safety pin to the recess in the moving shaft. Therefore, the safety pin prevents the moving shaft from moving in the axial direction due to an external cause such as a power stoppage or the like, thereby preventing the ink forming rollers from falling down. Furthermore, when the ink forming rollers are replaced, the safety pin can be removed from the moving shaft against the urging force, making the moving shaft movable in the axial direction and the ink forming rollers replaceable.

DETAILED DESCRIPTION OF THE INVENTION

An embodiment according to the present invention will now be described in detail with reference to the drawings.

Figure 2:
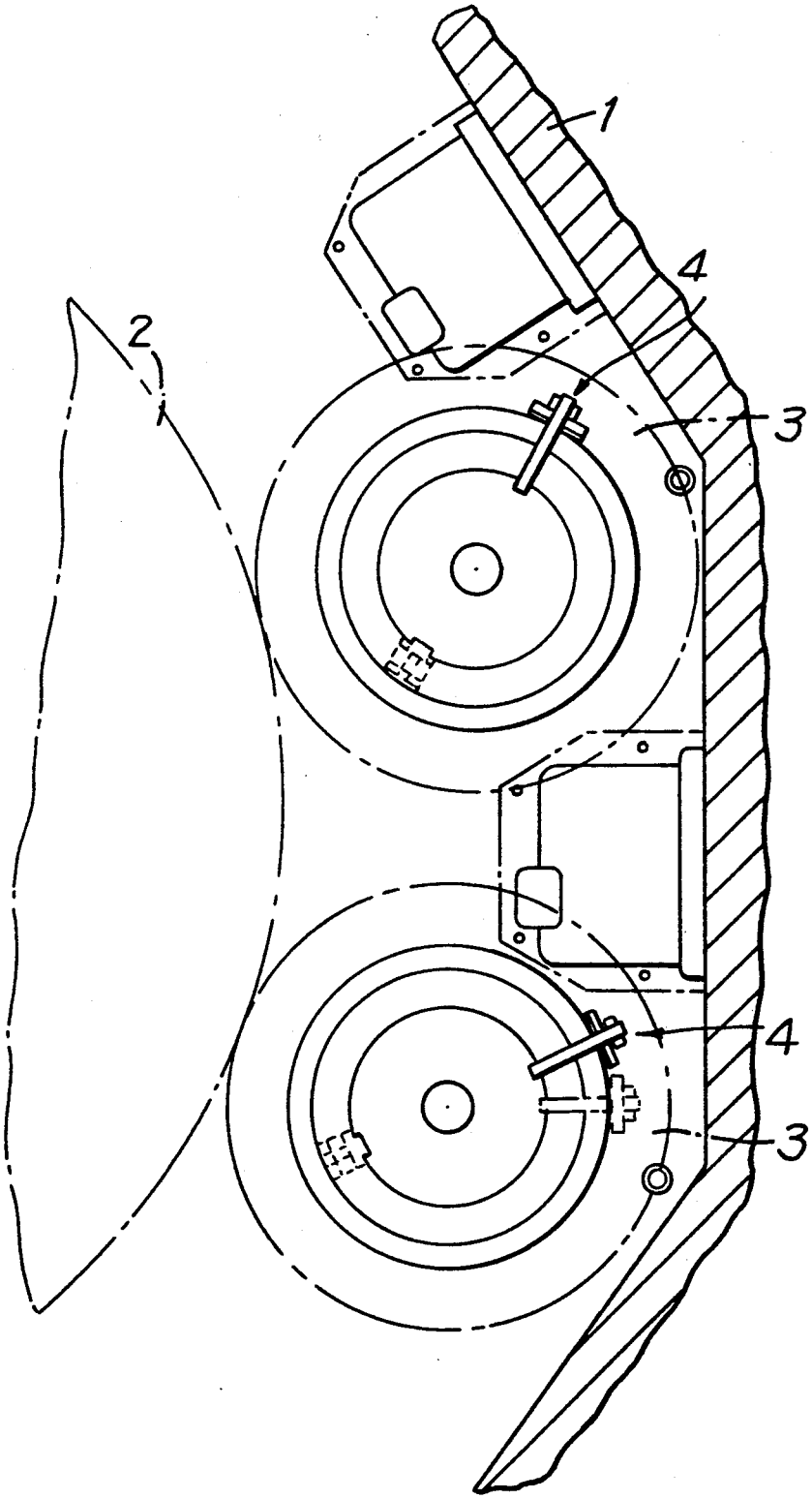
FIG. 2 is a schematic cross sectional view of a printing machine.

As shown in FIG. 2, a plurality of ink forming rollers 3 are supported on shafts in contact with a plate cylinder 2 which is supported on a frame 1 of a printing machine. Each of the ink forming rollers 3 is provided with a safety device 4.

Figure 3:
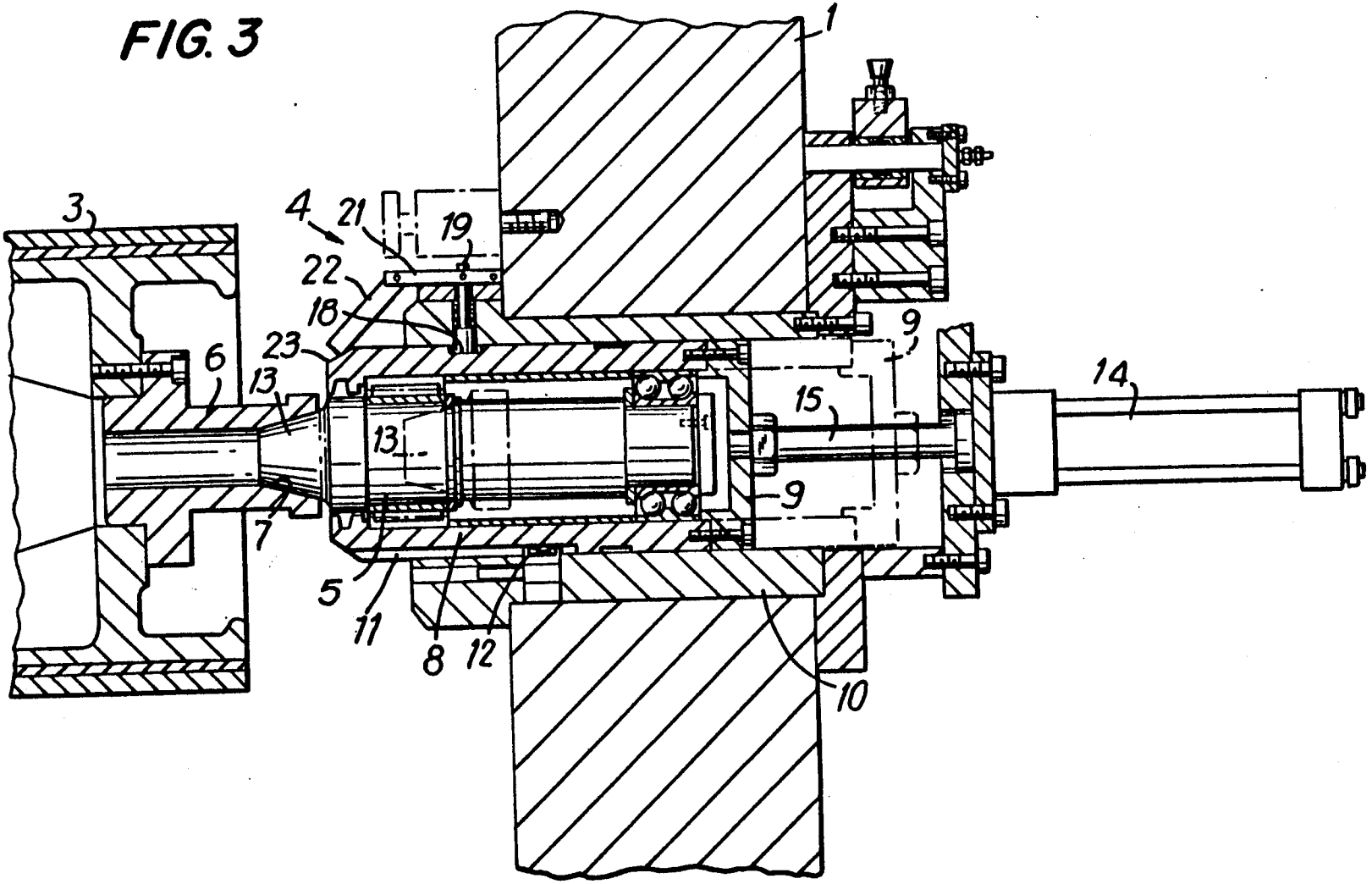
FIG. 3 is a schematic cross sectional view of an ink forming roller.

Referring to FIG. 3, one end of the ink forming roller 3 is rotatably supported on one frame by a supporting shaft (not shown) and the other end is supported on the frame 1 by an axially movable shaft 5.

Specifically, a cylindrical connecting member 6 is fixedly mounted to the said other end of the ink forming roller 3, and a tapered bore 7 is formed in the connecting member 6. A cylindrical member 8 engages with the outer periphery of the moving shaft 5 and supports a disk 9 at its end. The cylindrical member 8 is supported by a sleeve 10 mounted in the frame 1.

An axial grove 11 is formed on the outer periphery of the cylindrical member 8, and a key 12 is fixed to the inner periphery of the sleeve 10. The key 12 engages with the groove 11 to support the cylindrical member 8, and in turn the moving shaft 5, so as to be movable in the axial direction relative to the sleeve 10, but unrotatable in the circumferential direction.

The moving shaft 5 is integrally formed with an engaging portion 13 for engagement with the tapered portion 7 of the connecting member 6. A hydraulic cylinder 14 is supported by the frame 1, and the front end of a connecting rod 15 of the hydraulic cylinder 14 is connected to the disk 9 of the cylindrical member 8. The hydraulic cylinder 14 is also connected with a hydraulic pump (not shown) to supply hydraulic pressure.

Therefore, the hydraulic cylinder 14 can be actuated to move the cylindrical member 8 and the shaft 5 either to an ink forming roller 3 supporting position, as indicated by solid lines in FIG. 3, in which the engaging portion 13 is engaged by the tapered portion 7, or, to an ink forming roller 3 replacement position, indicated by double broken lines in FIG. 3, in which the tapered portion 7 is withdrawn from the engaging portion 13.

Figure 1:
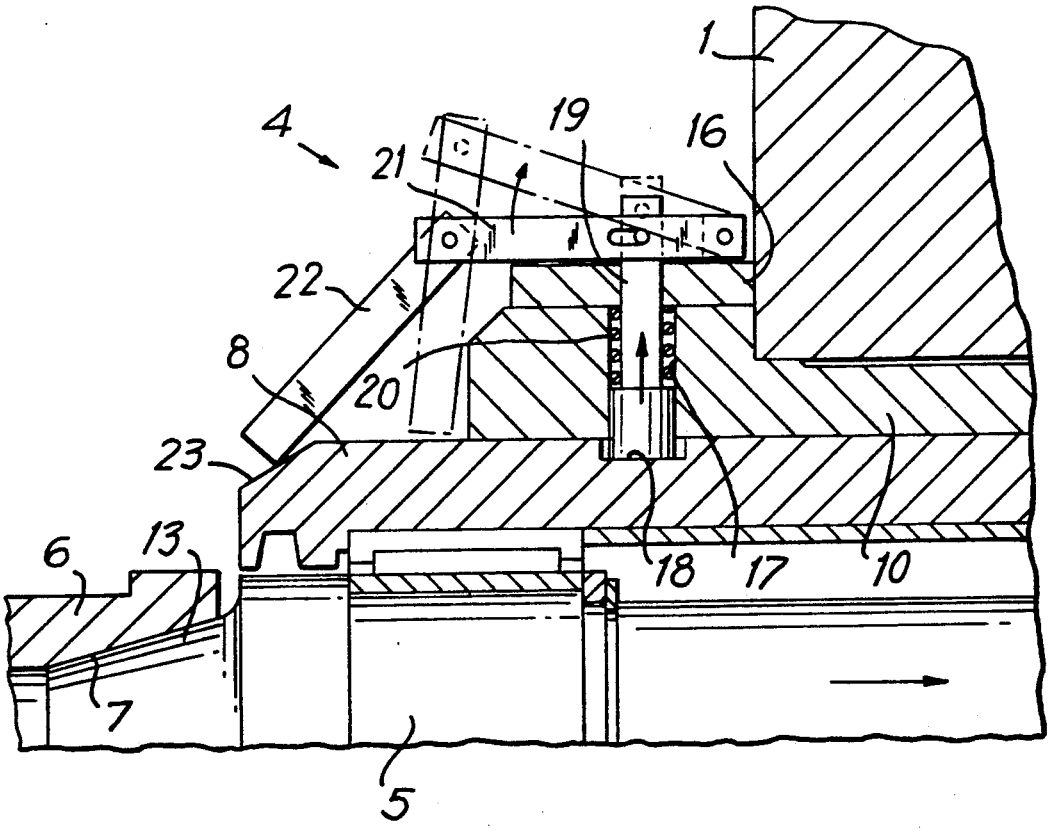
FIG. 1 is a schematic cross sectional view showing an embodiment of the safety device for ink forming rollers according to the present invention.

A safety device 4 is provided to prevent the ink forming roller 3 from falling down. As shown in FIG. 1, a bracket 16 is mounted on the outer periphery of one end of the sleeve 10. A through hole 17 extends through the bracket 16 and through the bearing 10. A recess 18 is formed at the outer periphery of the cylindrical member 8, at a position corresponding to the through hole 17. A locking pin 19 is slidably supported in the through hole 17, and is urged by a spring 20 in a direction to engage within the recess 18 of the cylindrical member 8.

The rear end of an operation lever 21 is rotatably supported on the bracket 16, and on the front end of the operation lever 21 is mounted a latch 22. The operation lever 21 is slidably connected to the locking pin 19 by a pin and slot connection. Therefore, by turning the operation lever 21 in the direction of the arrow in FIG. 1, the locking pin 19 can be moved in the arrow direction to remove the front end from the recess 18 of the cylindrical member 8, and, the latch 22 can then be turned for its free end to contact against the outer periphery of the cylindrical member 8, as indicated by broken lines in the Figure.

One end of the cylindrical member 8 is formed with an inclined surface 23 to guide the locking pin 19 to the recess 18 when the ink forming roller 3 is mounted.

An ink forming roller 3 is mounted, by moving the cylindrical member 8 with the moving shaft 5 to the position shown in FIG. 1, i.e., in the leftwards direction, during which time the protruding locking pin 19 is pushed by the inclined surface 23 to move upwards in FIG. 1 against the urging force of the spring 20. Further leftwards movement of the cylindrical member 8 then causes the locking pin 19 to engage within the recess 18.

As shown in FIG. 1 and 3, the locking pin 19 is then urged by the spring 20 to engage within the recess 18 of the cylindrical member 8 and the moving shaft 5 and its supporting cylindrical member 8 are thus locked against movement in axial directions, and, the ink forming roller 3 is thus locked in a predetermined operating position in which the engaging portion 13 is firmly engages within the tapered portion 7. In this case, even when the hydraulic pump stops operating due to an external cause, such as a power stoppage or the like, the shaft 5 is held by the locking pin 19 against movement in the axial direction, and, the ink forming roller 3 remains positively held in the said predetermined position.

When the ink forming roller 3 is to be replaced, first the latch 22 is turned to move the locking pin 19 out of engagement with the moving shaft 5, thus releasing the cylindrical member and the shaft 5 for movement in the axial direction. Then, the hydraulic cylinder 14 is actuated to release the engaging portion 13 of the moving shaft 5 from the tapered portion 7, thus allowing removal of the ink forming roller 3 for replacement.

At this time, since the cylindrical member 8 has moved to the inside the bearing 10, the latch 22 has no supporting surface, and the locking pin 19 is moved to the locked position by the spring 20.

To mount another ink forming roller 3, that ink forming roller 3 is set in the frame, and the hydraulic cylinder 14 is then operated to cause the engaging portion 13 of the moving shaft 5 to engage into within the tapered portion 7. During this movement, the locking pin 19 is raised by the inclined surface 23, and, when the cylindrical member 8 reaches the roller supporting position, the locking pin 19 is moved by the spring 20 to engage within the recess 18 and thus lock the cylindrical member 8 in that position. The latch 22 then contacts the cylindrical member 8. However, since the spring 20 has pushed down the locking pin 19, the operation lever 22 remains in the state indicated by solid lines in FIG. 1.

Thus, a safety device 4 having a locking pin 19 is provided in addition to the hydraulic cylinder 14, thereby preventing the ink forming roller 3 from falling down in the event of a power stoppage or the like. Furthermore, since the locking pin 19 is always urged by the spring 20 in the engaging direction, when the moving shaft 5 is moved to mount the ink forming roller 3, the locking pin 19 automatically engages with the recess 18 to lock the ink forming roller in place.

I claim:

1. A support for a rotary cylinder of a printing press, comprising:

an annular cylindrical member;

a shaft member supported within said annular cylindrical member for movement exclusively in a rotational direction relative to said annular cylindrical member;

a frame supporting said annular cylindrical member for movement exclusively in directions axially of said annular cylindrical member;

drive means carried by said frame member and operative to move said annular cylindrical member between an advanced and a retracted position;

spring biased locking means supported by said frame member and engageable with a corresponding locking formation on said annular cylindrical member, and operative to lock said annular cylindrical member in a specific position of axial adjustment relative to said frame member;

cam means carried by said annular cylindrical member operative to move said spring biased locking means against said spring bias upon movement of said annular cylindrical member from said retracted position to said advanced position, and then permit locking engagement of said locking means with said locking formation under the bias of said spring; and, manually operable means for withdrawing said locking means against the bias of said spring means;

whereby, in the event of failure of said drive means, said annular cylindrical member, when in an advanced position of adjustment, will remain locked in that position until said spring biased lock means is manually released from said annular cylindrical member.

2. The support of claim 1, in which said lock means is a pin movable in a direction perpendicular to the axis of said annular cylindrical member, and said spring means is operative to bias said lock means toward said axis of said annular cylindrical member, and into locking engagement with said locking formation.

3. The support of claim 1, in which said locking formation is a recess formed in an outer peripheral surface of said annular cylindrical member, and said cam means is a ramp cam formed on a leading end of said annular cylindrical member.

4. The support of claim 1, in which said shaft member includes surfaces for locking engagement with corresponding locking surfaces formed on an adjacent axial end of a said rotary cylinder.

5. The support of claim 1, in which said manually-operable means is a pivoted lever, further including means for holding said lever in an operated position during movement of said annular cylindrical member towards said retracted position, and, for releasing said lever upon movement of said annular cylindrical member towards said advanced position.

* * * * *